United States Patent [19]

Friedman et al.

[11] Patent Number: 4,690,656

[45] Date of Patent: Sep. 1, 1987

[54] WHEEL AND WINCH ASSEMBLIES UTILIZING IDENTICAL HUBS AND AXLES IN A TOY CONSTRUCTION SET

[75] Inventors: Walter Friedman, Newbury; David J. Stricker, Salem, both of Mass.

[73] Assignee: Kenner Parker Toys, Inc., Beverly, Mass.

[21] Appl. No.: 749,258

[22] Filed: Jun. 27, 1985

[51] Int. Cl.[4] ..... A63H 17/00; A63H 33/30; A63H 17/26

[52] U.S. Cl. ..... 446/95; 446/424; 446/465; 446/469

[58] Field of Search ..... 446/85, 93, 95, 424, 446/425, 427, 465, 469, 470, 471, 96, 103, 120, 124

[56] References Cited

U.S. PATENT DOCUMENTS

| | | | |
|---|---|---|---|
| 1,754,672 | 4/1930 | Dyresen | 411/509 X |
| 2,577,702 | 12/1951 | DeSwart | 446/96 |
| 2,778,159 | 1/1957 | Irwin | 446/465 |
| 3,201,897 | 8/1965 | Balthazor | 446/427 X |
| 3,263,363 | 8/1966 | Doe | 446/465 |
| 3,464,147 | 9/1969 | Fischer | 446/103 |
| 3,611,861 | 10/1971 | Schulze | 411/508 |
| 3,646,706 | 3/1972 | Adickes | 446/465 |
| 3,905,570 | 9/1975 | Nieuwveld | 411/510 X |
| 4,170,083 | 10/1979 | Freelander et al. | 446/95 |
| 4,299,051 | 11/1981 | Pauley et al. | 446/471 |
| 4,375,139 | 3/1983 | Chatani | 446/471 |
| 4,585,426 | 4/1986 | Rasmussen et al. | 446/469 X |

FOREIGN PATENT DOCUMENTS

| | | | |
|---|---|---|---|
| 0085542 | 8/1983 | European Pat. Off. | 446/93 |
| 0128449 | 12/1984 | European Pat. Off. | 446/465 |
| 600997 | 8/1934 | Fed. Rep. of Germany | 24/570 |
| 2649017 | 10/1976 | Fed. Rep. of Germany | 446/93 |
| WO86/01738 | 3/1986 | PCT Int'l. Appl. | 446/95 |

*Primary Examiner*—Robert A. Hafer
*Assistant Examiner*—D. Neal Muir
*Attorney, Agent, or Firm*—L. MeRoy Lillehaugen; Gene O. Enockson; Stuart R. Peterson

[57] ABSTRACT

Included in a toy construction set is a special block having an axle projecting therefrom, the axle having a slot providing a pair of resilient legs with a groove formed near the free end of each leg. A hub has a bore so that the hub can be journaled for rotation on the axle, the bore having an annular rib therein to provide a releasable snap-action retention. A resilient tire is provided so that it can be mounted on the hub to provide a wheel assembly. Also, a crank unit is provided so that it can be attached to the hub to provide a winch assembly, a locking pin then being available to either allow or prevent rotation of the hub on the axle.

16 Claims, 15 Drawing Figures

36
38
39
40
42
44
46
48
50
52
54
60
62
64
66
68
70
74
76
78
82
84
88
102
104
106
108
110
116
120
122
124
126
128
130
132
134
136
138
5

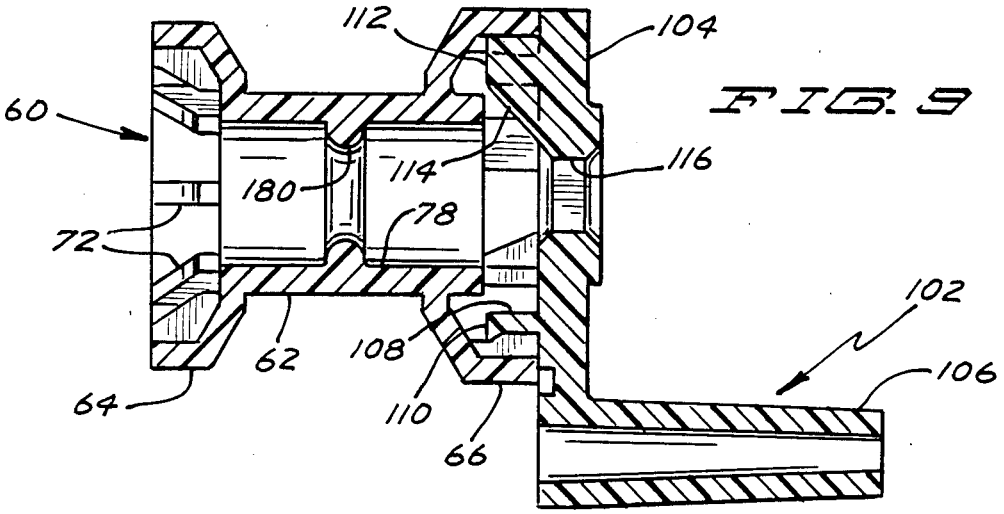
FIG. 9
FIG. 10
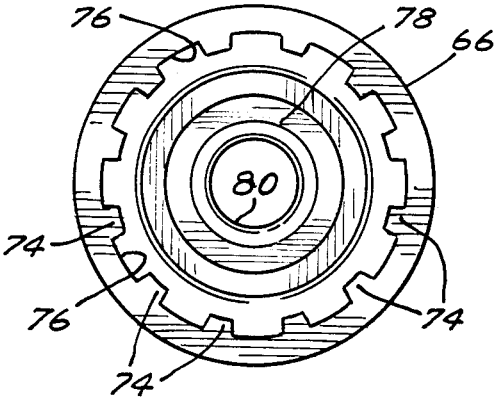
FIG. 11
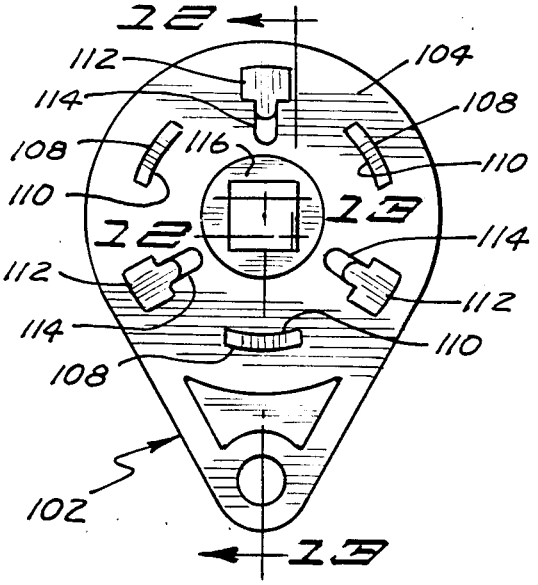
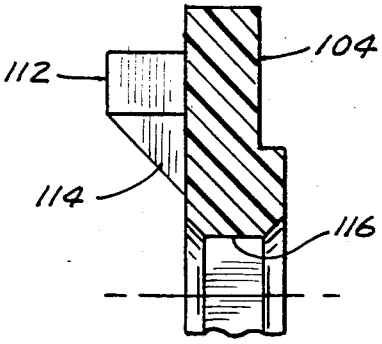
FIG. 12
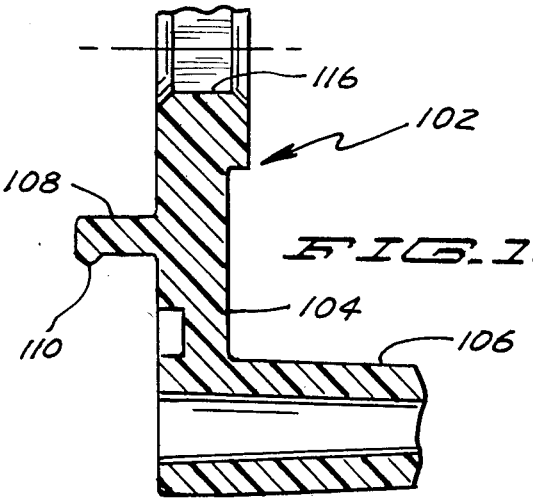
FIG. 13

WHEEL AND WINCH ASSEMBLIES UTILIZING IDENTICAL HUBS AND AXLES IN A TOY CONSTRUCTION SET

CROSS-REFERENCE TO RELATED APPLICATION

This application contains subject matter generally related to U.S. patent application Ser. No. 613,842, filed May 24, 1984 for "TOY CONSTRUCTION SET", now issued as U.S. Pat. No. 4,551,110.

BACKGROUND OF THE INVENTION

1. Field of the Invention

This invention relates generally to toy construction sets in which small blocks or bricks are releasably interconnected so that the child can build various geometric configurations, and pertains more particularly to a toy construction set in which wheel and winch assemblies can be constructed with identical hubs and axles.

2. Description of the Prior Art

Although it is known to us that blocks or bricks can be attached and detached from each other, there are instances in which special configurations are desired. In the past, expressly designed parts or components have been fabricated in order to enable the child to produce certain types of automobiles, trucks, racing cars, airplanes, tanks, cranes and the like, each of such configurations requiring special parts not usable in another of such configurations. Quite obviously, fabricating a complex mold can be quite costly, and to make any more molds than absolutely necessary in order to realize desired configurations increases dramatically the cost of manufacturing the construction set.

In spite of the increased costs, it has been the practice to mold whatever parts or components are needed in order to achieve the sought after assembly. In other words, the cost of providing the desired variety and challenge in a toy construction set has been accepted as being necessary in order to provide diverse assemblies. Where assemblies, each of which differs from the others require a number of different parts, the manufacturing cost, quite obviously, is compounded by the number of special parts that are required.

SUMMARY OF THE INVENTION

A general object of our invention is to provide a considerable amount of variety with respect to the items or assemblies to be built with a toy construction set, doing so without significantly increasing the set's manufacturing cost. More specifically, an aim of the present invention is to provide a construction set with wheel and winch assemblies employing identical hubs and identical axles so that these identical parts can be employed to produce functionally different geometric configurations.

Another object of the invention is to provide duplicate components that can be easily assembled and disassembled to produce a chosen design.

Another object is to provide specially configured components, which are rugged, being sufficiently sturdy so that they are not apt to be broken even when subjected to relatively rough handling and abuse.

Still another object of the invention is to provide a construction set making use of common parts that will prove interesting to the child in that they cultivate the child's imagination as far as selecting different designs to be constructed.

Also, the invention has for an object the improvement of the child's dexterity in that more intricately constructed assemblies can be realized.

Still further, the invention has for an object the visual training of the child, for an instruction manual can be furnished with step-by-step procedures for building specific assemblies or subassemblies. Yet, this does not detract from the above object relating to the enhancement of the child's imagination because the instruction manual need only present certain basic combinations that can be built, whereas the child is still free to orginate assemblies that are not pictorially suggested in the manual.

Briefly, the invention envisages the use or various toy blocks that can be individually connected together in a desired three-dimensional pattern. It is planned, though, that certain of the blocks be specially formed with integral axles onto which specially configured hubs can be rotatably mounted. The hubs can have mounted thereon either of two types of tires to provide a desired wheel assembly. On the other hand, hubs can serve as a drum for a winch where the geometric configuration to be built is to constitute a crane. By predetermining where a block with the axle is to be located, the hub, when journaled thereon, can function as the hub of a wheel for various types of vehicles or can function as the drum of a winch when so desired.

BRIEF DESCRIPTION OF THE DRAWINGS

FIG. 9 is another sectional view similar to FIGS. 7 and 8 but with the locking pin removed so as to show to better advantage the cross sectional make up of the winch assembly;

FIG. 10 is an end view of the larger end of the hub, the view being taken from the right in FIG. 2;

FIG. 11 is a face view of the prong side of the crank unit;

FIG. 12 is an enlarged sectional detail taken in the direction of line 12—12 of FIG. 11;

FIG. 13 is an enlarged sectional detail taken in the direction of line 13—13 of FIG. 11;

DESCRIPTION OF THE PREFERRED EMBODIMENTS

Figure 1:
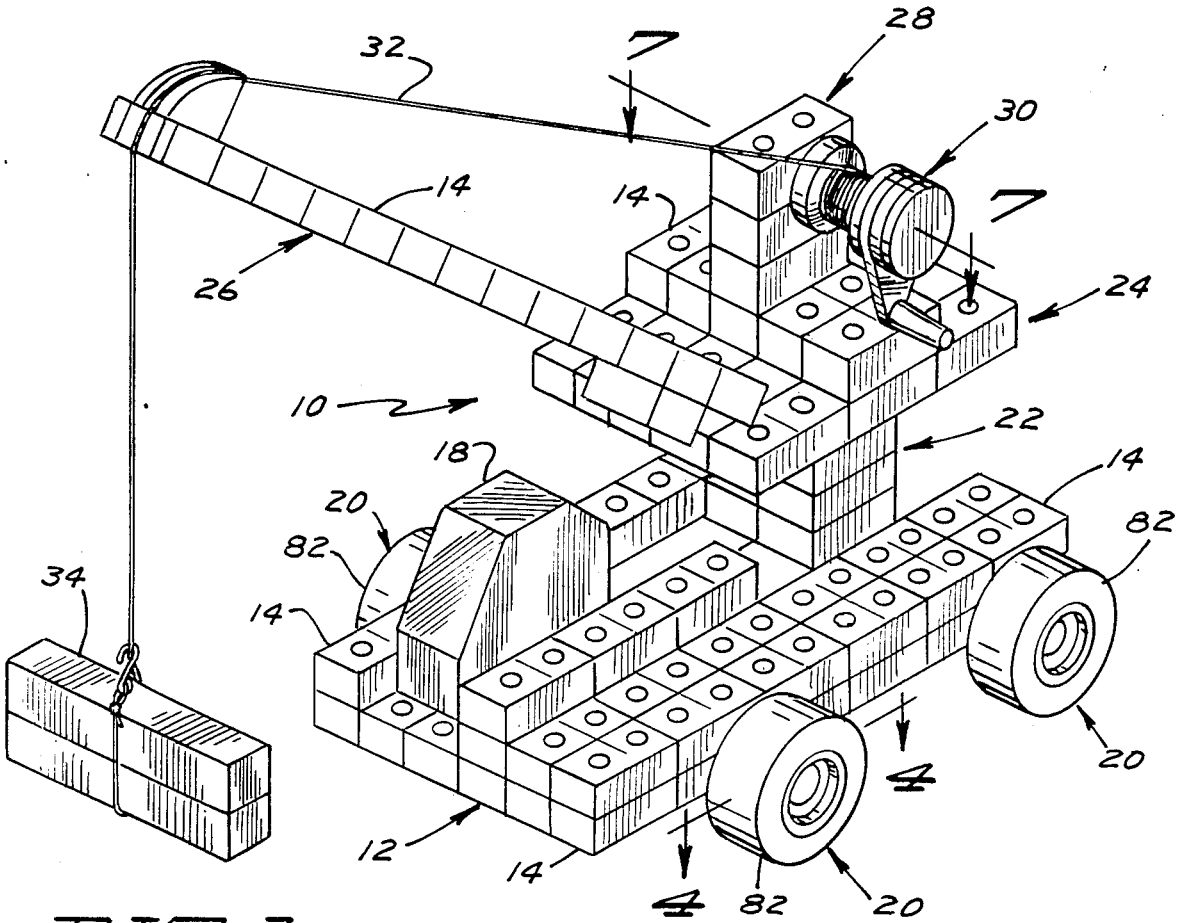
FIG. 1 is a perspective view of a mobile crane employing our invention therein.

Although the invention makes it possible to construct various geometric forms, a toy crane indicated generally by the reference numeral 10 has been selected for the purpose of illustrating the invention. The crane 10 includes a chassis 12 composed of a number of small blocks or bricks 14, such as those described in the patent application hereinbefore identified. Although not visible in FIG. 1, there is a base plate to which the blocks 14 are attached. Inasmuch as the blocks 14 and their mode of connection to each other are fully described in said copending application, the blocks 14 will not herein be further described with the exception of one specially configured block that plays an important role in the practicing of the invention. A simulated control cab 18 is mounted on the chassis 12.

The toy crane 10 further includes four large wheel assemblies indicated generally by the reference numeral 20, the right rear one of which is concealed by some of the blocks 14. Additionally included in the depicted crane 10 is an upstanding substructure 22 composed of individual blocks 14 that have been interconnected to support thereon a platform 24, also composed of a number of the blocks 14. Extending at an angle from the platform 24 is a boom 26 composed of additional blocks 14 that have been assembled together.

Also, as illustrated in FIG. 1, there is a support 28 for a winch assembly 30. There is additionally a cord or string 32 that simulates a cable, one end of the cord 32 being attached to the winch assembly 30 and extending over the upper or free end of the boom 26. For the sake of completeness, a load 34, which can also be comprised of several individual blocks 14 that have been connected together, is suspended at the free end of the cord 32, as clearly understandable from FIG. 1.

Figures 2, 3:
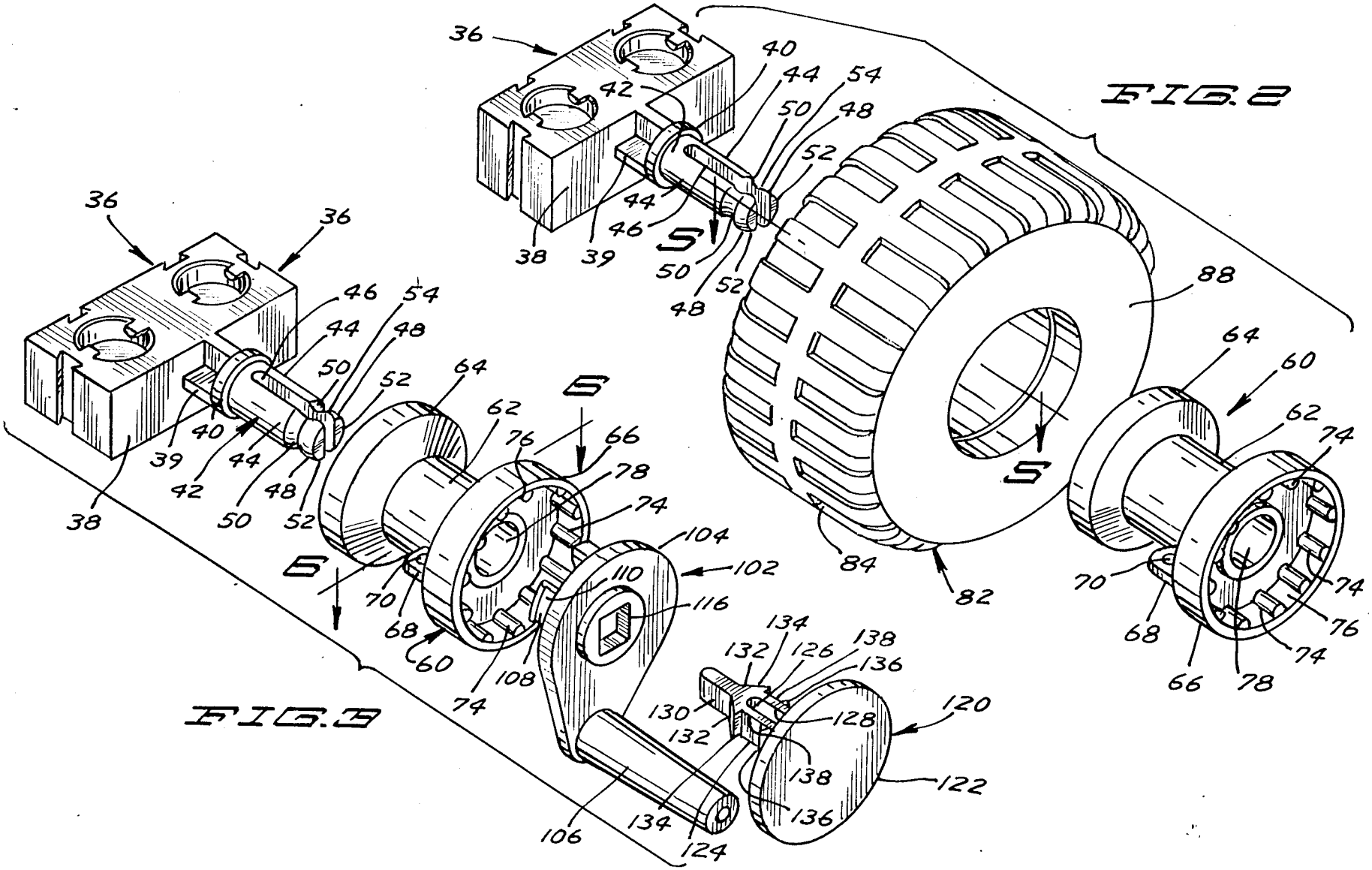
FIG. 2 is an exploded perspective view of one of the wheel assemblies appearing in FIG. 1, the view illustrating a special block and its integral axle, a hub and a relatively large tire which collectively constitute one wheel assembly embodiment.
FIG. 3 is an exploded perspective view of the winch assembly, the view depicting the same special block of FIG. 1 and its integral axle, the same hub, a crank unit and a locking pin to permit rotation of the winch assembly when in one position and to prevent rotation of the winch assembly in a second position.

Describing now one of the wheel assemblies 20, attention is directed to FIG. 2 (as well as FIG. 4) where a special block 36 is illustrated, which has only been generally mentioned above. The block 36 corresponds in shape to the blocks 14 that generally comprise the toy crane 10, even though the various blocks 14 that for the most part have been used to form the crane 10 have not had their construction specifically identified inasmuch as they are described in detail in said copending application that has been herein identified. The special block 36 is adapted to be connected to other blocks 14, such as those described in said copending application, but differs therefrom in that its side or face 38 has a cruciform 39 integral therewith and projecting therefrom. There is also a reinforcing flange 40. More importantly there is an axle 42 that is integral with the flange 40. The axle 42 is bifurcated in that it has a pair of legs 44 created by virtue of a slot 46. Each leg 44 has a bulbous head 48 at its free end. Each leg 44 additionally has a circumferentially or transversely extending arcuate groove 50. It will be observed that each bulbous head 48 has a curved cam surface 52 and another curved cam surface 54. The reason for the cam surfaces 52, 54 will become manifest hereinafter.

At this time attention is directed to a spool-shaped hub 60 having a cylindrical drum 62 formed with a smaller diameter cylindrical or cup-shaped rim 64 at one end and a larger diameter cylindrical or cup-shaped rim 66 at its other end. It will be perceived that there is an ear 68 having a hole 70 therein, the ear 68 serving as a means for attaching one end of the cord 32 to the winch assembly 30, as will later become clear.

For the sake of completeness, reference will be made at this time to a series of angularly spaced lugs 72 integrally formed within the smaller cup-shaped rim 64, as can readily be seen in FIGS. 6–9. It is important to note the forming of angularly spaced lugs 74 within the larger rim 66 in that these lugs 74 serve as teeth as will be presently explained. The lugs or teeth 74 have spaces 76 therebetween.

It should be observed that a cylindrical bore 78 extends completely through the drum 62 of the spool-like hub 60. As perhaps best seen in FIG. 6, approximately midway in the bore 78 is an internal annular rib 80. The function of the rib 80 is to releasably retain the free end of the axle 42 within the bore 78. This is achieved by virtue of the resiliency of the two legs 44. As the axle 42 is inserted into the bore 78, the cam surfaces 52 urge the bulbous heads 48 at the ends of the legs 44 closer together, doing so sufficiently so that the heads 48 can pass the internal rib 80. Once the heads 48 have been forced past the rib 80, then the resiliency of the legs 44 causes the heads 48 to return to their original or unflexed relation so that the cam surfaces 54 yieldably resist the withdrawal of the axle 42 from the confines of the bore 78. It will be appreciated that after the axle 42 has been inserted far enough into the bore 78, the slot 46 allows the heads 48 to be pressed toward each other when caused to do so by the internal rib 80 as the heads 48 are manually forced therepast. The retentive action resulting rrom the engagement of the heads 48, more specifically, from their camming surfaces 54, causes the axle to be is only gently retained within the bore 78 (see FIG. 8). In this regard, the bottoms or bases of the grooves 50 in the two legs 44 of the axle 42 have a transverse distance therebetween that corresponds substantially to the internal diameter of the annular internal rib 80. Hence, only a moderate pull is required in order to withdraw the axle 42 from the bore 78. At this time, though, it should be observed that the axle 42 does not extend all the way through the bore 78, only partially therethrough. From the description just given it should be apparent that there is a form of snap-action retention of the axle 42 within the bore 78.

The wheel assembly 20 includes a large tire 82 molded from a suitable elastomer, such as rubber or an appropriate plastic polythelene. The tire 82 has a tread 84, sidewalls 86 and 88, and an internal sleeve 90. In this way, a toroidal void 91 is formed (see FIG. 5).

Figure 4:
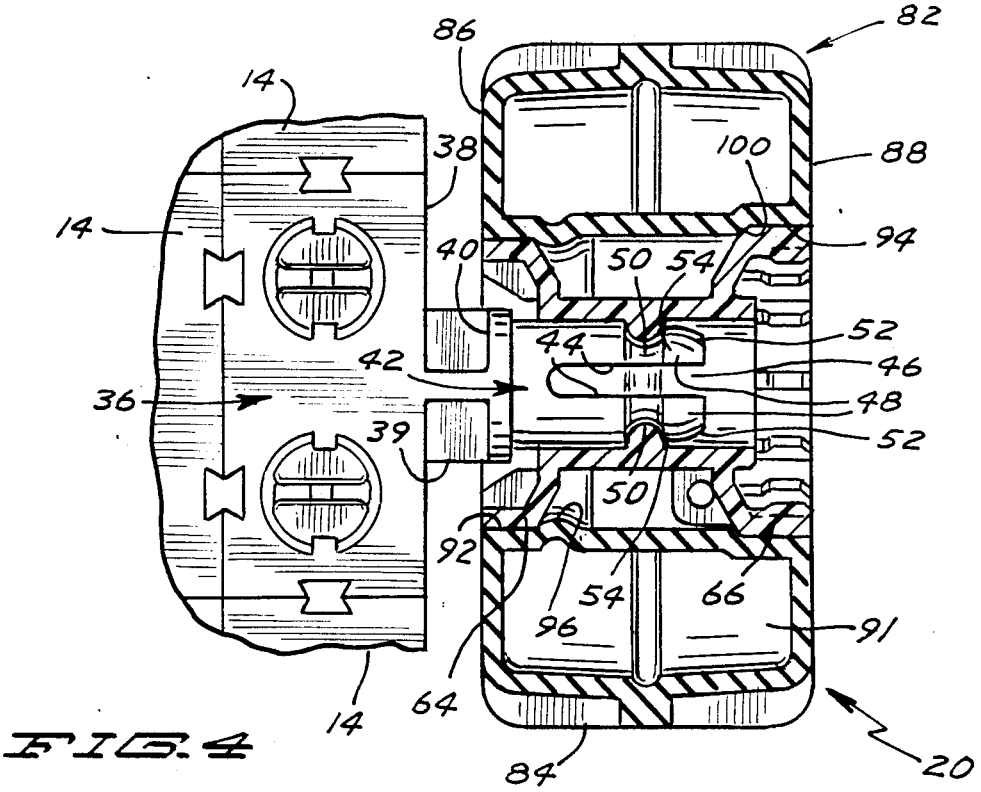
FIG. 4 is an enlarged horizontal section through one of the wheel assemblies of FIG. 1, the view being taken in the direction of line 4—4.
Figure 5:
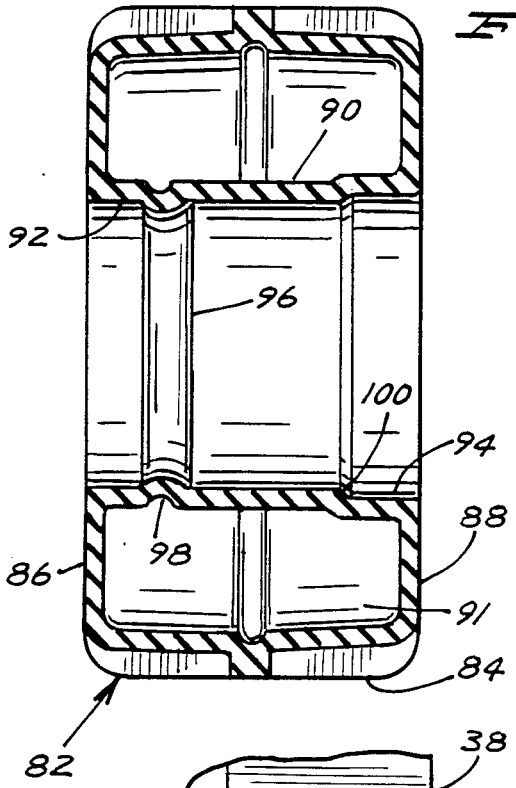
FIG. 5 is a horizontal sectional view of the tire shown in FIG. 2, the view being in the direction of line 5—5 of this figure.
Figure 6:
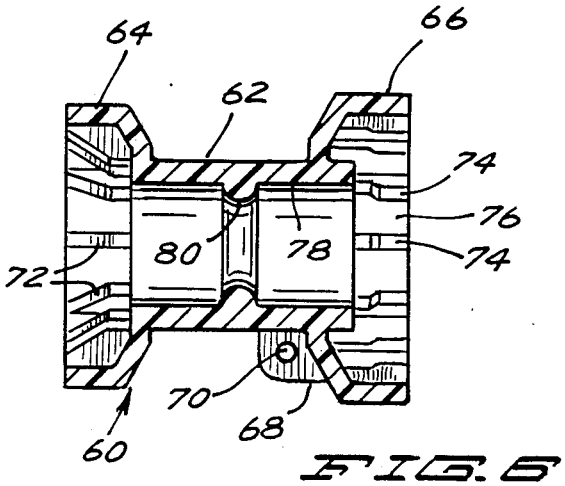
FIG. 6 is a sectional view taken in the direction of line 6—6 of either FIGS. 2 or 3.

What can be termed cylindrical beads or sleeves 92 and 94 are also integral with the tire 82, these beads 92, 94 being of a size so as to fit tightly over the earlier-mentioned cylindrical rims 64 and 66, respectively. More precisely, the internal diameter of the bead 92 corresponds closely to the outside diameter of the rim 64, whereas the internal diameter of the bead 94 corresponds closely to the outside diameter of the rim 66. FIG. 5 depicts the beads 92 and 94, and FIG. 4 depicts the cylindrical rims 64 and 66 received therein. However, notice should be taken of an internal resilient rib 96 having a groove 98, the groove 98 making the rib 96 somewhat more flexible and pliable so that the rib 96 will expand when the cylindrical rim 64 is pressed there against so as to permit the advancement of the rim 64 into the fitted relationship with the bead 92, all as shown in FIG. 4. There is a shoulder 100 that the larger cylindrical rim 66 bears against, as can also be discerned from FIGS. 4 and 5.

Inasmuch as one of the main objectives of the invention is to enable different assemblies to be constructed, the winch assembly 30 will now be described in detail. Note especially FIGS. 3 and 6–13. At the outset, though, it should be emphasized that the winch assembly 30 makes use of an identical block 36 having a bifurcated axle 42 that is integral therewith, such block 36 having been described in conjunction with the wheel assembly 20. Inasmuch as the hub 60 is also identical in the assembly 30, the details thereof need not be redescribed. What is different in the winch assembly 30 from that included in the wheel assembly 20 resides in the use of several different components or parts.

The first different component or part to be described is the crank unit which has been identified by the reference numeral 102. The crank unit 102 comprises a disk 104 having a handle 106 thereon. Several resilient fingers 108 project from the face of the disk 104 opposite to that from which the handle 106 extends. Each of the resilient fingers 108 is formed with a lip 110 (best understood from FIG. 13) that enhances the frictional retention of the crank unit 102 when the fingers 108 are inserted into the notches 76 residing between the angularly spaced lugs or teeth 74. There are additional lugs 112, being somewhat narrower than the fingers 108, that impart a greater strength to the crank unit 102, especially by virture of the angled gussets 114 associated with each lug 112, as can best be seen from FIG. 12. There is a square hole 116 formed in the disk 104; this square hole 116 is clearly visible in FIG. 11.

When the crank unit 102 is engaged with the spool-like hub 60, as can best be appreciated from FIG. 9, then the winch assembly 30 is operable so as to wind the cord or string 32 about the drum 62 inasmuch as one end of the cord 32 is tied to the ear 68 by means of the hole 70 therein.

However, with the arrangement illustrated in FIG. 9, it will be understood that there is no way of locking the winch assembly 30 so that any load 34 thereon will be maintained at a given hoisted elevation. Provision is made for locking the winch assembly 30 in whatever hoisting condition it is advanced to by reason of a locking pin, denoted generally by the reference numeral 120. The locking pin 120 includes a circular disk 122 having a square cross-section shank 124 projecting from one side thereof, the shank 124 having a slot 126 therein so as to provide parallel leg portions 128. It is planned that a resilient plastic be used as the material for the locking pin 120. The leg portions 128, while connected at the end thereof adjacent the disk 122, are also connected to each other adjacent a blocking tab 130. The blocking tab 130 is formed with sloping cam surfaces 132. Stated somewhat differently, the sloping cam surfaces 132 merge into the blocking tab 130.

Figure 7:
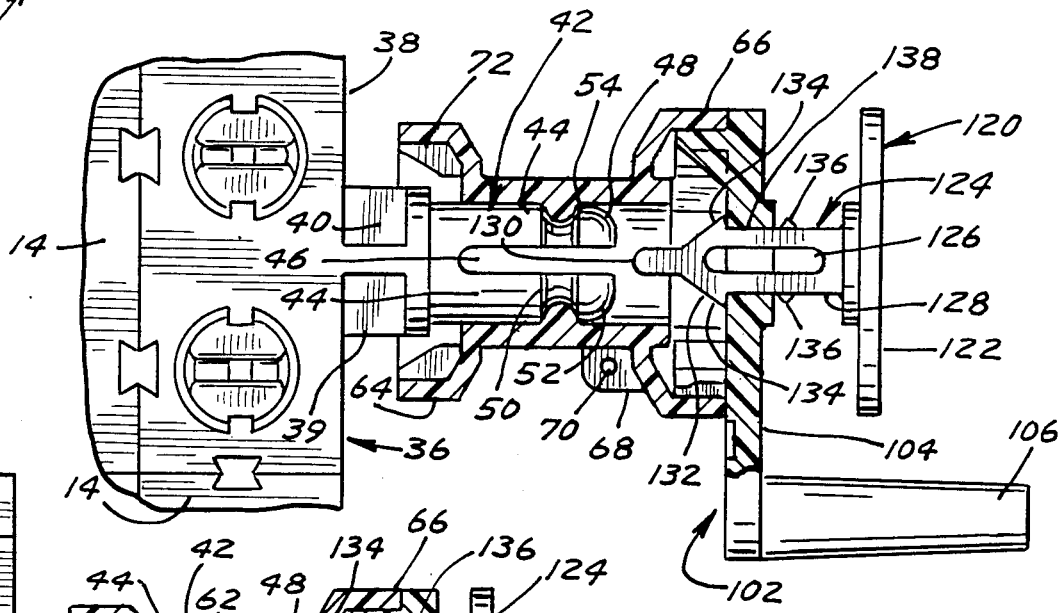
FIG. 7 is a sectional view through the winch assembly, the view being taken in the direction of line 7—7 of FIG. 1 with the locking pin retracted so that the winch can be manually rotated.
Figure 8:
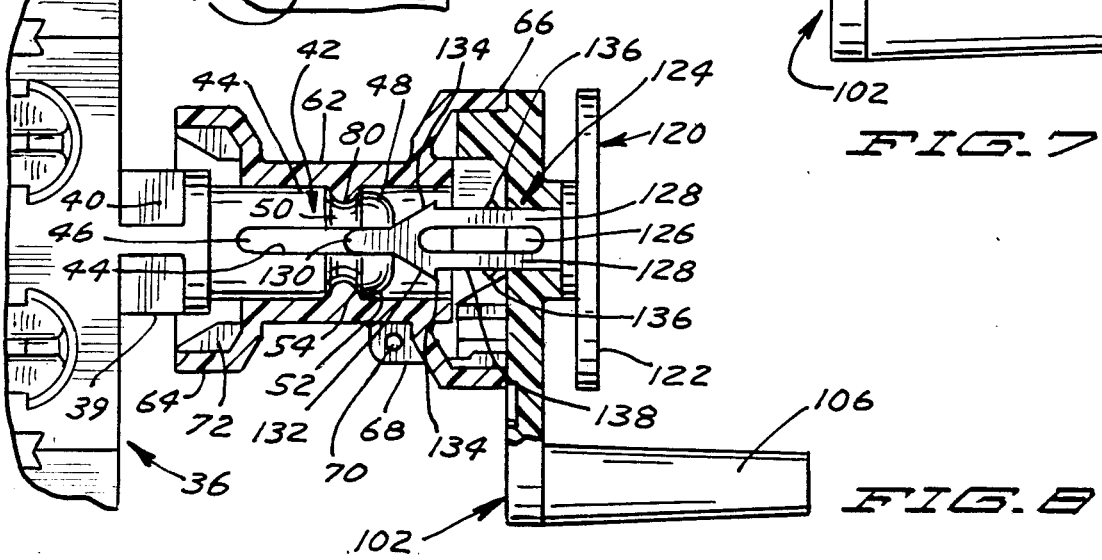
FIG. 8 is a sectional view corresponding to FIG. 7 but with the locking pin in its locking position so as to prevent rotation of the winch.

Close inspection of FIGS. 3, 7 and 8 will reveal the presence of a first pair of oppositely issuing retention ribs 134 and a second pair of such ribs 136. It will be recognized that the ribs 134 are located quite close to the cam surfaces 132 which merge into the blocking tab 130. Hence, the ribs 134 when acted upon are less prone to flex the leg portions 128 toward each other than are the ribs 136. It should also be noted from FIGS. 3, 7 and 8 that there is a shallow notch 138 residing between the ribs 134 and 136.

It is intended that the locking pin 120 be removable or completely detachable from the crank unit 102. This is where the ribs 134 and 136 serve a relatively important retention function. Assuming at the moment that the shank 124 of the locking pin 120 is to be inserted into the square hole 116 provided in the disk 104, it follows that sufficient manual force exerted by the child will cause the ribs 134 to press against the sides of the square hole 116 and sufficient force or pressure will cause the leg portions 128 to be pressed toward each other so that the ribs 134 then pass completely through the square hole 116. This is the condition portrayed in FIG. 7. It is in the unlocked position of the pin 120 that permits the crank unit 102 to be rotated through the agency of its handle 106.

On the other hand, when rotation of the crank unit 102 is to be precluded, and more importantly the rotation of the spool-like hub 60, then the locking pin 120, by means of the disk 122, can be pressed farther to the left, as viewed in FIG. 8, so as to establish an interfering engagement of the locking tab 130 with the slot 46 formed between the legs 44 of the axle 42. Inasmuch as the axle 42, being integral with the special block 36, cannot rotate, then it follows that the crank unit 102 cannot rotate, for the tab 130 is at this time projecting into the slot 46. The hub 60 with which the crank unit 102 is engaged via the meshed fingers 108 of the crank unit 102 and the teeth 74 within the cup-shaped rim 66, it follows that the hub 60 and its drum 62 cannot rotate. In this way, a locking relationship results.

Thus, the child can push the locking pin 120 from the position shown in FIG. 7 to the position illustrated in FIG. 8 and can also retract the locking pin 120 from the position in which it appears in FIG. 8 back to the position of FIG. 7. Normal movement between these two positions is achieved by virtue of the limiting or restricting effect of the ribs 134 and 136. More specifically, the locking pin 120 is shiftable between the two positions, the shifting distance in a retractive direction being restricted by the ribs 134, and the engagement of the tab 130 with the bifurcated axle 42 limiting movement in the other or locking direction. The ribs 134, of course, restrict complete removal of the locking pin 120 from the crank unit 102 until the child exerts enough pull to flex the ribs 134 sufficiently so as to permit the shank 124 to pass back through the square hole 116.

Figure 14:
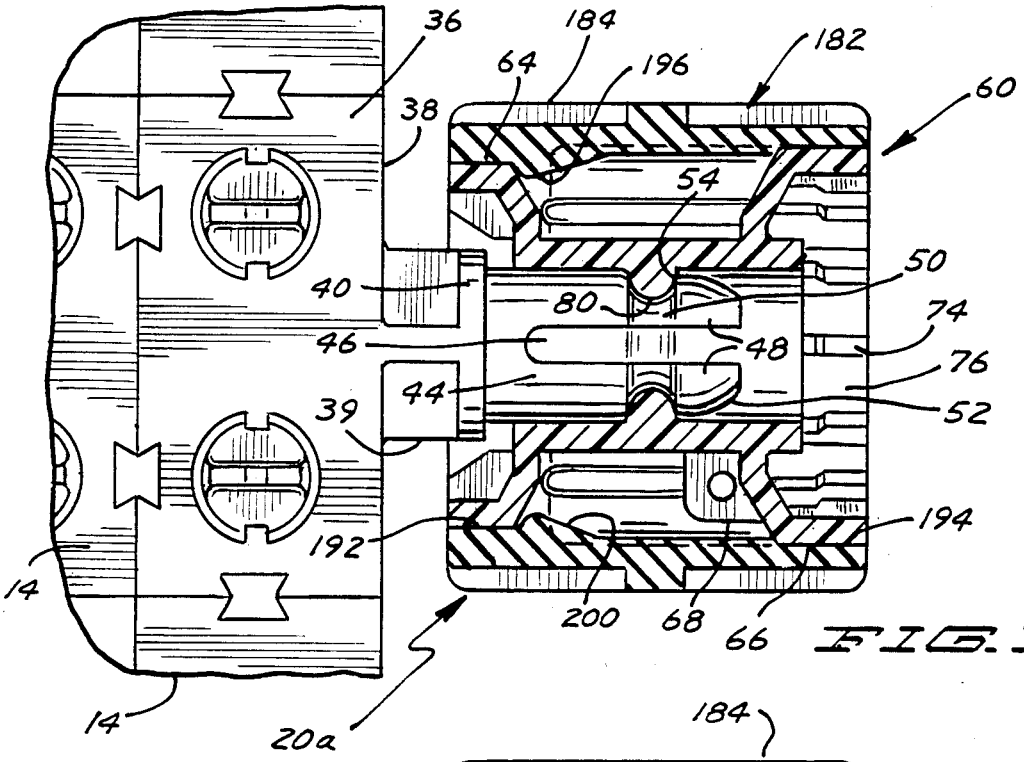
FIG. 14 is a sectional view similar to FIG. 4 but depicting a somewhat different wheel assembly.
Figure 15:
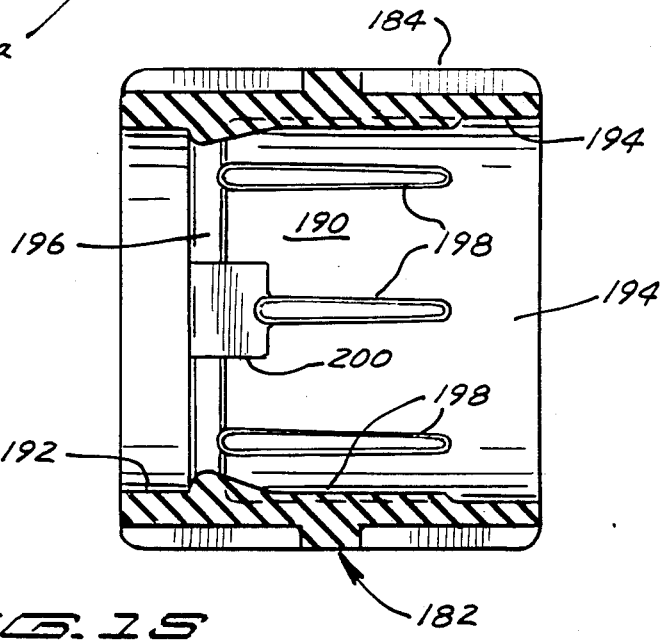
FIG. 15 is a sectional view similar to FIG. 5 but illustrating the embodiment shown in FIG. 14.

To demonstrate the versatility of the invention, reference will now be made to FIGS. 14 and 15 where a modified wheel assembly is pictured. The wheel assembly 20*a* comprises a relatively small tire 182, the tire being a solid tire in contradistinction to the hollow tire 82. The solid tire 182 has a tread 184 and a bore 190 extending therethrough. The bore 190 has formed therein a cylindrical bead 192 corresponding to the cylindrical bead 92 of the earlier-described embodiment. Likewise, there is a cylindrical bead 194 of somewhat larger diameter that corresponds to the cylindrical bead 94, the beads 192 and 194 being of a size so as to accomodate therein the rims 64 and 66, respectively, of the hub 60. The relatively small tire 182 has an annular internal resilient rib 196 extending circularly around the bore 190. Additionally, there are angularly spaced longitudinal ribs 198 within the bore 190 terminating in sloping ramps 200.

When inserting the hub 60 into the relatively small tire 182, the child advances the hub 60, but doing so from the right as far as the tire 182 is concerned. In other words, the relatively small cylindrical rim 64 is moved to the left and when it reaches the ramps 200, the forward edge of the rim 64 wedges against the ramps 200 and expands them somewhat outwardly, causing the internal resilient rib 196 to likewise expand. The expansion of the rib 196 enables the relatively small rim 64 to pass to the left of the rib 196 so that the cylindrical rim 64 then resides within the confines of the cylindrical bead 192 belonging to the tire 182. At this time, the relatively large rim 66 resides in the cylindrical bead 194, bearing against the right ends of the longitudinal ribs 198, as can be readily perceived in FIG. 14. In other words, the insetting of the longitudinal ribs 198 provides the cylindrical bead 194.

While three embodiments of the invention have been disclosed, each utilizing two identical parts or components, these being the special block 36 with its axle 40 and the hub 60, it will be recognized that an imaginative child will come up with other designs where these identical parts can be employed. The invention allows the child to display as much ingenuity as he is capable of supplying.

We claim:

1. In a toy construction set, a block, an axle projecting from one side of said block, said axle including a pair of legs formed by a slot therebetween, a spool-shaped hub journaled for rotation on said axle, means releasably engaging said legs to maintain said hub on said axle, and shiftable locking means having a tab movable into said slot to prevent rotation of said hub and movable out of said slot to permit rotation of said hub.

2. A toy construction set as defined in claim 1 including a resilient tire mounted on the ends of said spool-shaped hub.

3. A toy construction set as defined in claim 1 including angularly spaced teeth on said hub and angularly spaced teeth on said crank unit, said respective teeth being intermeshed with each other to transmit rotation of said crank unit to said hub.

4. A toy construction set as defined in claim 1 including a crank unit mounted on one end of said spool-shaped hub.

5. A toy construction set as defined in claim 4 including means interengageable with said crank unit and said axle to prevent rotation of said hub.

6. In a toy construction set, a block adapted to be attached to other blocks, an axle projecting from one side of said block, a hub member having a bore therein of greater length than that of the axle so that said axle extends only partway through said bore, said hub member being spool-shaped and having a cylindrical rim at each end thereof, means releasably retaining said axle within said bore, and a crank unit having means thereon engageable with one of said cylindrical rims, said means on said crank unit including a plurality of angularly spaced spring fingers extending from a crank disk inside larger diameter rim, each of said spring fingers having a lip at the free end thereof for resiliently bearing against the inner surface of said one rim.

7. A toy construction set as defined in claim 6 including a plurality of angularly spaced internal teeth in said larger cylindrical rim forming spaces therebetween, said spring fingers extending into at least some of said spaces.

8. A toy construction set as defined in claim 7 including locking means engageable with said crank unit and said axle to prevent rotation of said hub.

9. A toy construction set as defined in claim 8 in which said crank unit includes a disc having a rectangular opening therein and said locking means has a shank extending through said rectangular opening and shiftable into engagement with said axle to prevent the rotation of said hub member.

10. A toy construction set as defined in claim 9 in which said axle has a slot and said shank has a tab, said tab being shiftable into said slot to prevent said hub from rotating.

11. A toy construction set as defined in claim 10 in which said shank has a longitudinal slot therein forming parallel resilient leg portions, first and second transverse ribs on each of said leg portions forming shallow notches therebetween, said first ribs being nearer said tab, said first ribs resisting removal of said locking means from said cranking unit and said second ribs resisting engagement and disengagement of said tab with said axle slot.

12. A toy construction set as defined in claim 11 in which said locking means includes a circular disc, said shank projecting from one side of said disc, whereby said disc facilitates manual shifting of said shank to engage and disengage said tab relative to said axle slot.

13. In a toy construction set, a plurality of special blocks adapted to be attached to other blocks, an axle projecting from one side of each of said special blocks, and a plurality of identical spool-shaped hubs having a bore therein, means for releasably engaging said axles to retain at least a portion of said axles within said bores, a tire on at least one of said hubs to provide a wheel assembly, a crank unit on another of said hubs to provide a winch assembly, and locking means having a shank portion extending through said crank unit and shiftable into obstructive through which said shank portion extends and the cross section of said shank portion also being noncircular to prevent rotation of said crank unit relative to said locking means.

14. A toy construction set as defined in claim 13 in which said axle has a slot into which said shank portion projects to provide said obstructive engagement with said axle.

15. In a toy construction set, a plurality of special blocks adapted to be attached to other blocks, an axle projecting from one side of each of said special blocks, and a plurality of identical spool-shaped hubs having a bore therein, means for releasably engaging said axles to retain at least a portion of said axles within said bores, said axles extending only partway through said bores, a tire on at least one of said hubs to provide a wheel assembly, and a crank unit on another of said hubs to provide a winch assembly, said crank unit provided for engaging a portion of said hub.

16. In a toy construction set, a block adapted to be attached to other blocks, an axle projecting from one side of said block, a hub member having a bore therein of greater length than than of the axle so that said axle extends only partway through said bore, said hub member being spool-shaped having a rim at each end thereof, said hub member having an ear with a hole therein for the attachment of one end of a cord, a crank unit having means thereon engageable with one of said cylindrical rims, and means releasably retaining said axle within said bore, said releasably retaining means including an annular rib in said bore, and said axle having a longitudinal slot therein so as to form a pair of resilient legs, the free end portions of which legs have grooves formed therein for receiving segments of said rib.

* * * * *

UNITED STATES PATENT AND TRADEMARK OFFICE

CERTIFICATE OF CORRECTION

PATENT NO. : 4,690,656

DATED : September 1, 1987

INVENTOR(S) : Walter Friedman, David J. Stricker

It is certified that error appears in the above-identified patent and that said Letters Patent are hereby corrected as shown below:

Col. 2, line 17; "or" should be -- of --;
Col. 4, line 39; "rrom" should be -- from --;
Col. 7, lines 57-58; "inside larger" should be -- inside said larger --;
Col. 8, line 34; after "obstructive" insert -- engagement with said axle, said crank unit having a noncircular hole --;
Col. 8, line 51; "provided for" should be -- provided with means for --;
Col. 8, line 55; "than than" should be -- than that --.

Signed and Sealed this

Twenty-ninth Day of December, 1987

*Attest:*

DONALD J. QUIGG

*Attesting Officer*

*Commissioner of Patents and Trademarks*